US005722211A

United States Patent [19]

Goldschmidt

[11] Patent Number: 5,722,211

[45] Date of Patent: Mar. 3, 1998

[54] RAIL STRUCTURE TO SUPPORT FLAT STRUCTURAL ELEMENTS

[76] Inventor: Rolf Goldschmidt, Luftmattstrasse 15, CH-4052, Basel, Switzerland

[21] Appl. No.: 356,198

[22] PCT Filed: Jul. 10, 1993

[86] PCT No.: PCT/DE93/00621

§ 371 Date: Jan. 20, 1995

§ 102(e) Date: Jan. 20, 1995

[87] PCT Pub. No.: WO94/02693

PCT Pub. Date: Feb. 3, 1994

[30] Foreign Application Priority Data

Jul. 23, 1992 [DE] Germany ..... 42 24 285.1

[51] Int. Cl.[6] ..... E04C 2/42

[52] U.S. Cl. ..... 52/665; 52/664; 52/480; 52/650.3; 108/51.1

[58] Field of Search ..... 52/660, 664, 665, 52/480, 650.3; 108/51.1

[56] References Cited

FOREIGN PATENT DOCUMENTS

| | | |
|---|---|---|
| 0 259 223 | 3/1988 | European Pat. Off. . |
| 2 501 332 | 9/1982 | France . |
| 2 557 900 | 7/1985 | France . |
| 1 684 602 | 12/1969 | Germany . |

*Primary Examiner*—Carl D. Friedman
*Assistant Examiner*—Beth A. Aubrey
*Attorney, Agent, or Firm*—Baker & Daniels

[57] ABSTRACT

A bearer design to support flat structural components has two crossing pluralities of parallel pairs of bands where girders form the bands. The girders are secured so as not to rotate on the outside of the connecting members in selected crossover regions between the pairs of bands.

17 Claims, 5 Drawing Sheets

RAIL STRUCTURE TO SUPPORT FLAT STRUCTURAL ELEMENTS

Figure 1:
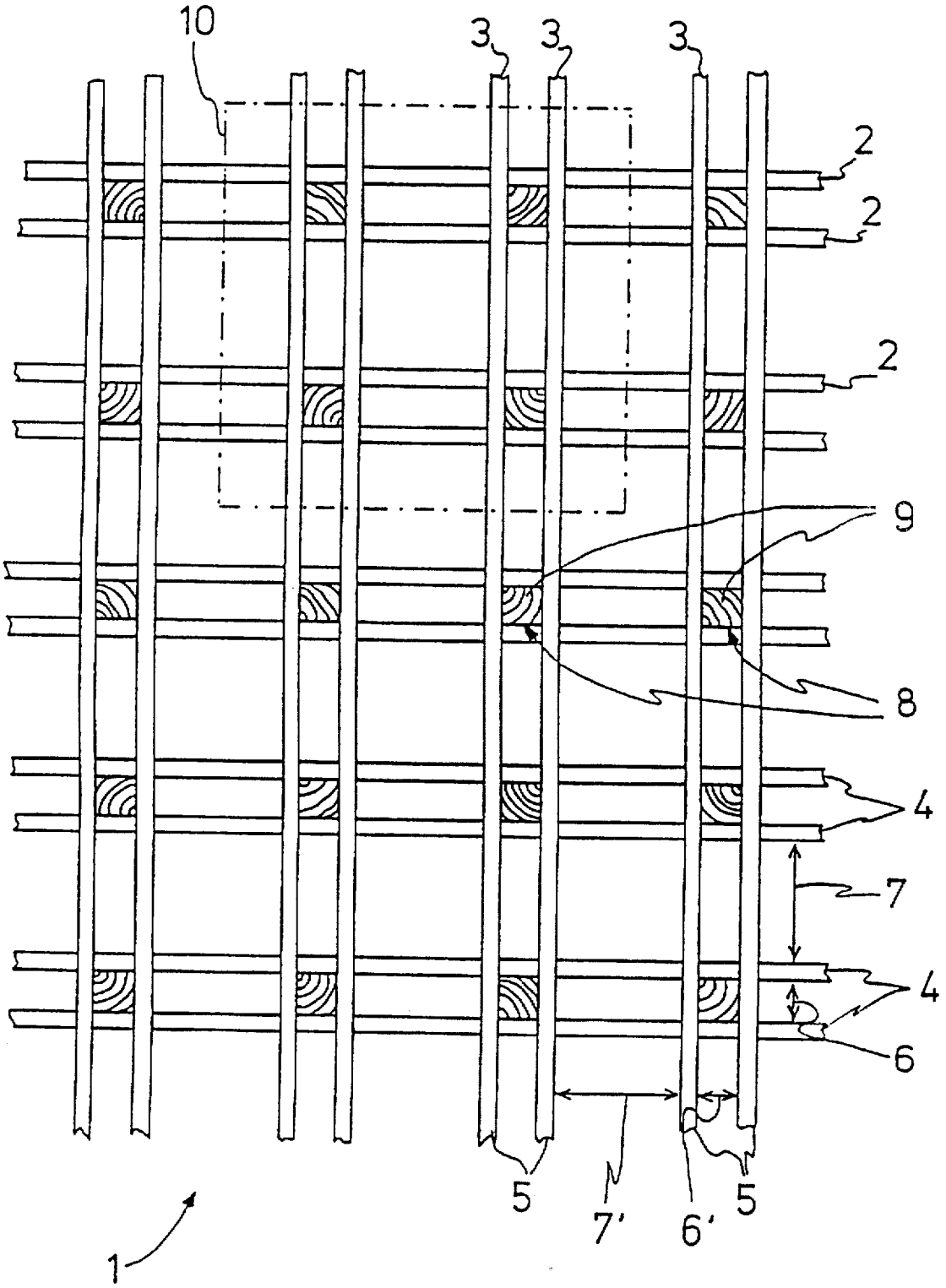

The invention concerns a rail structure to support flat structural elements, with a first plurality of paired stringers of parallel arrangement extending in a first plane, with a second plurality of paired stringers of parallel arrangement extending in a second plane, and with connecting pieces inserted in intersection areas formed by intersecting stringer pairs and joined to each bordering stringer.

Such rail structure is previously known from DE-OS 1 684 602. Provided as stringers are bar-shaped, cross-sectionally round wires or rods which with a plurality of connecting pieces stamped from sheet metal and introduced in the intersection areas are joined to one another so as to form a rail structure. In plan view, the connecting pieces are cruciform and connected to the individual stringers by bending the projections forming the cross shape with the aid of a special pair of pliers around the individual stringers. The rail structure receives its bending stability by clamping the stringers in the annularly bent projections.

The bending stability of the rail structure depends decisively upon the bending load strength of the individual stringers. With the stringers featuring a roundish, small cross-sectional area, as described in the publication, so that each individual stringer possesses only a relatively slight bending load strength, the bent-over projections in case of a load acting essentially perpendicularly on the plane formed by the rail structure are exposed to small forces. A risk of loosening of the clamping, in that the projections open up, is not given.

But when a high bending stability of the rail structure is desired, stringers with a distinctly greater cross-sectional area need to be used. The projections of the connector require then an appropriately stable layout so as not to bend open due to the higher load occurring then, in order to guarantee a reliable and durable fixing of the stringers. Such higher loads can be counteracted by providing an appropriately greater material strength of the connecting pieces. However, this will increase also the force necessary for bending the projections over and clamping them, so that a sufficient clamping can be carried out only with mechanical bending devices and/or presses. Besides, the metallic rail structure would assume a very heavy weight due to such a measure, impeding its handling.

Clamping cross-sectionally angled stringers is problematic, since the stringer edges provide only a small contact surface for generating the desired frictional contact.

Unfavorable on the object of this publication, additionally, is that the projections of the connecting pieces are bent around the rail elements, making a contact between a flat element arranged on the rail structure and the individual stringers impossible. When a flat element is to be reinforced by the rail structure against bending loads, said flat element already needs to be sufficiently stable to prevent a sagging between the contact areas with quasi punctual action, of the connecting pieces.

Known from FR-A-2 557 900 is a rail structure where roundish posts meant to be anchored in the ground have on both sides stringers arranged, with the stringers enclosing the posts forming the outside of a bottom surface backed by inside beams. The beams are placed on the inside stringers and arranged so as to extend parallel to one another in one direction. Provided on the inside of the three-dimensional rail structure, which for instance is formed of several stringers and beams arranged at different levels of the posts, are liners which, while arranged between the beams which are arranged on the stringers at various levels and form floors, form a wall which outwardly bounds the interior of the rail structure. All of the posts are located outside the interior of the rail structure, thereby not only backing the liner, but drying again after getting wet, for instance by rain, relatively quickly.

The posts serve to absorb the force of the weight, which for instance is distributed over several floors, and the two-sided arrangement of stringers around the posts on the outside of the rail structure enhances the stability of the posts. While a relatively high stability of the three-dimensional rail structure is achieved thereby, a high load strength of a floor backed merely by beams extending in one direction parallel to one another requires providing a relatively high cross section of the beams, which cross section increases the overall weight of the rail structure quite considerably.

Known from FR 2 501 332 is a rail structure provided as well for reinforcement of flat elements. On this rail structure, the individual stringers feature at their intersection points recesses that face one another, making the rail elements nestable. With the rail structure in nested state, the rail elements are contained in a single plane. The rail structure taught by the publication, however, features by itself, without being joined to a reinforcing surface element, only a very slight shear and distortion stability.

Basing on this prior art, the problem underlying the invention is to provide a rail structure for backing flat structural elements that can be produced with simple means and of structural elements, which rail structure not only will withstand high bending loads and boast a high distortion resistance, but which is characterized additionally by low weight so as to ensure a nonproblematic handling.

This problem is inventionally solved in that the stringers are arranged so as to completely enclose the connecting piece with equally aligned cross-sectional surfaces, in that the connecting pieces extend with the intersection areas essentially across the entire thickness of the rail structure, and in that the stringers, on the sections bounding the intersection areas, of their side faces facing the respective enclosed connecting pieces, are frictionally joined to the connecting pieces.

The arrangement of the stringers with equally aligned cross-sectional surfaces and completely enclosing the connecting piece confers to the rail structure a high bending strength and distortion resistance at a comparatively low expense of material. With the connecting pieces extending within the intersection areas essentially across the entire thickness of the rail structure, the stringers may be fastened frictionally, sideways, to the connecting pieces. This not only achieves, through the connection of the stringers extending in various planes, by the connecting pieces, a very high bending load strength and distortion resistance, but allows—owing to the reinforcing effect—selecting the cross section of the individual stringers in weight-saving fashion relatively small.

The connecting pieces preferably fill the intersection area formed by the crossing stringer pairs essentially completely, thus creating a maximum large-area contact between the individual stringers and the connecting pieces. The greater the cross-sectional area of the connecting pieces is chosen, the more stable will be the rail structure to shearing and distortion loads.

The two stringer pairs intersect preferably at essentially right angles, with smaller spacings being provided between the two stringers of a pair than between the relevant stringer pairs. The connecting pieces then assume with the flat expanse of the rail structure only a slight share, keeping the material consumption and, thus, the dead weight of the rail structure low.

For a uniform load strength of the rail structure, the spacing between stringer pairs as well as between the two flexible rails of a stringer pair will be provided equal in both planes. When different stability properties are required in longitudinal and transverse direction for a rail structure, the spacings of the flexible rails or stringer pairs, e.g., may be different in both planes.

In a preferred embodiment, the rail structure is made of slats and square lumber deriving from the least expensive major products of the lumber production. The fiber direction of the slats follows their longitudinal expanse, and the fiber direction of the connecting pieces extends essentially perpendicularly to the plane formed by the slats. Using wood as production material lends the rail structure a correspondingly low weight. Furthermore, any alterations required, for instance adaptation to curving edges, are possible with simplest means.

In the case of a rail structure made of wood it may be suitable to allow the connecting pieces to protrude beyond the outer narrow sides of the assembled slats. This prevents form changes of the slats, such as swelling, from transmitting to a flat element arranged on the rail structure.

For a simple and swift assembly of the rail structure, the side surfaces of the wood slats and the connecting pieces are suitably joined by means of double-sided fastening plates. The large joining area obtained thereby, in addition, has a favorable effect upon the stability of the rail structure.

The rail structure may be paneled on one or both sides with flat elements which need not serve a support function. The rail structure is particularly suited for applications requiring high bending load strength, distortion strength and/or shear strength.

Further favorable developments and applications of the rail structure derive from the figures description and the subclaims.

Figure 2:
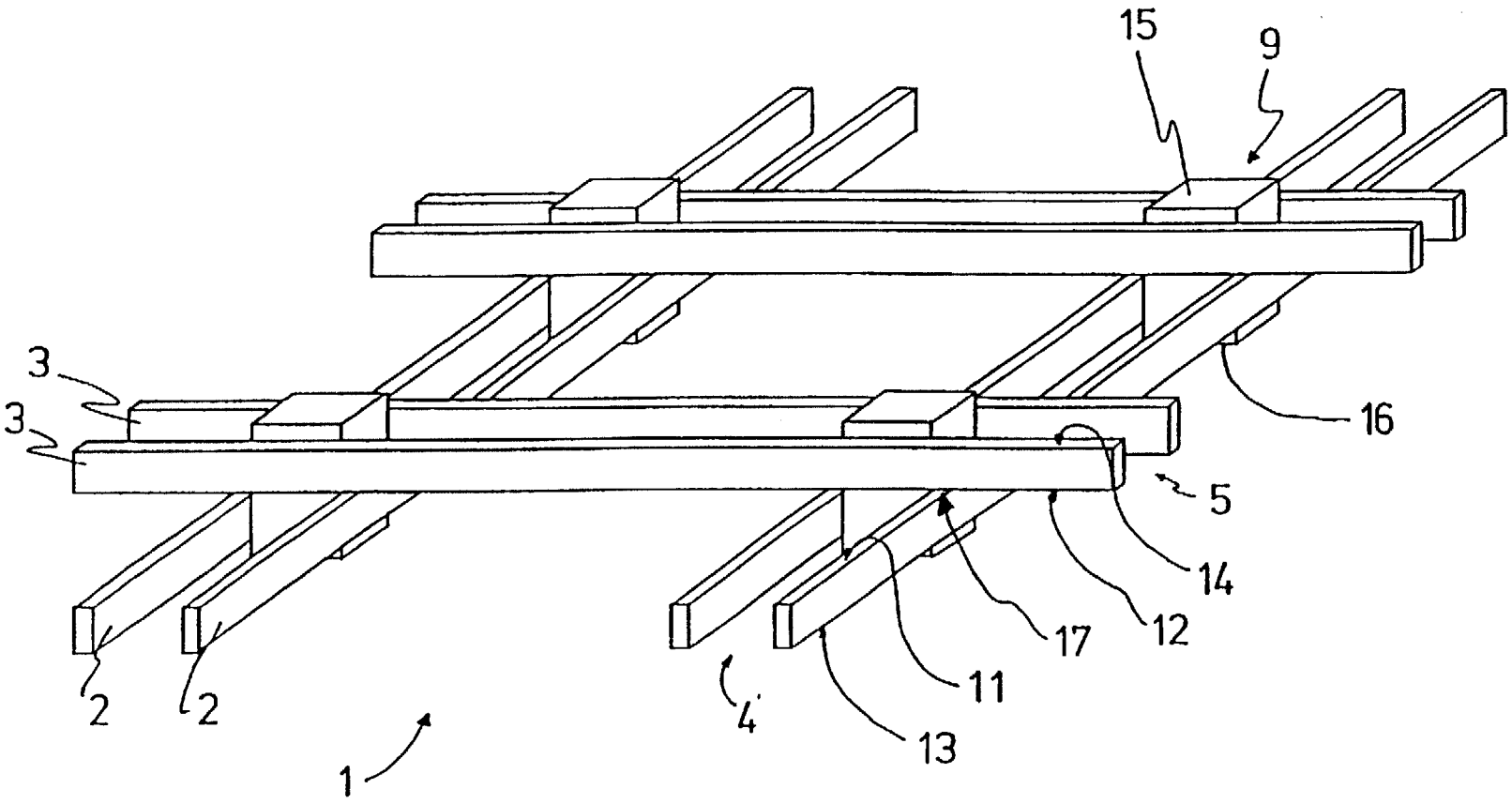
Figure 3:
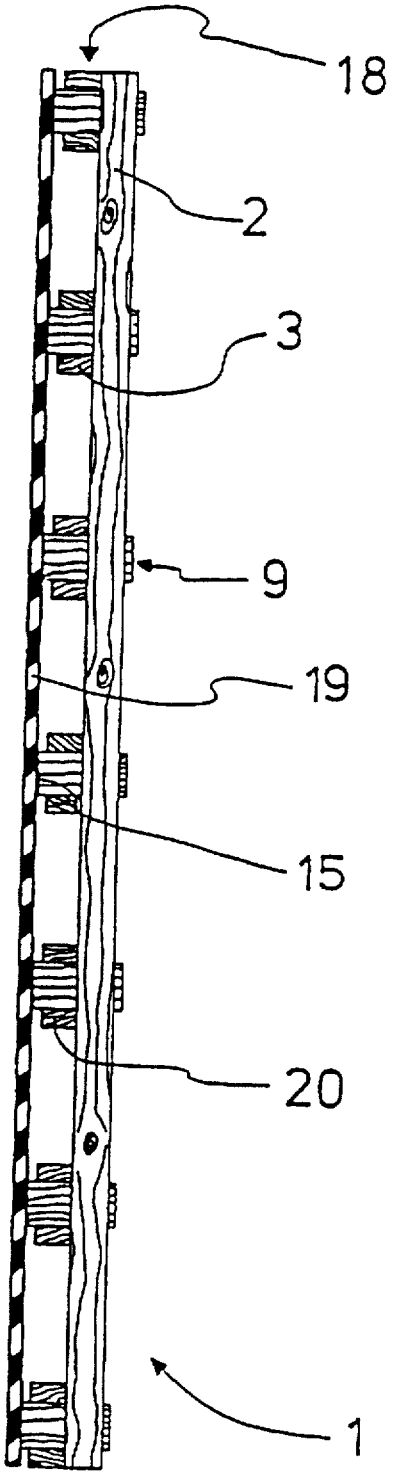
Figure 4:
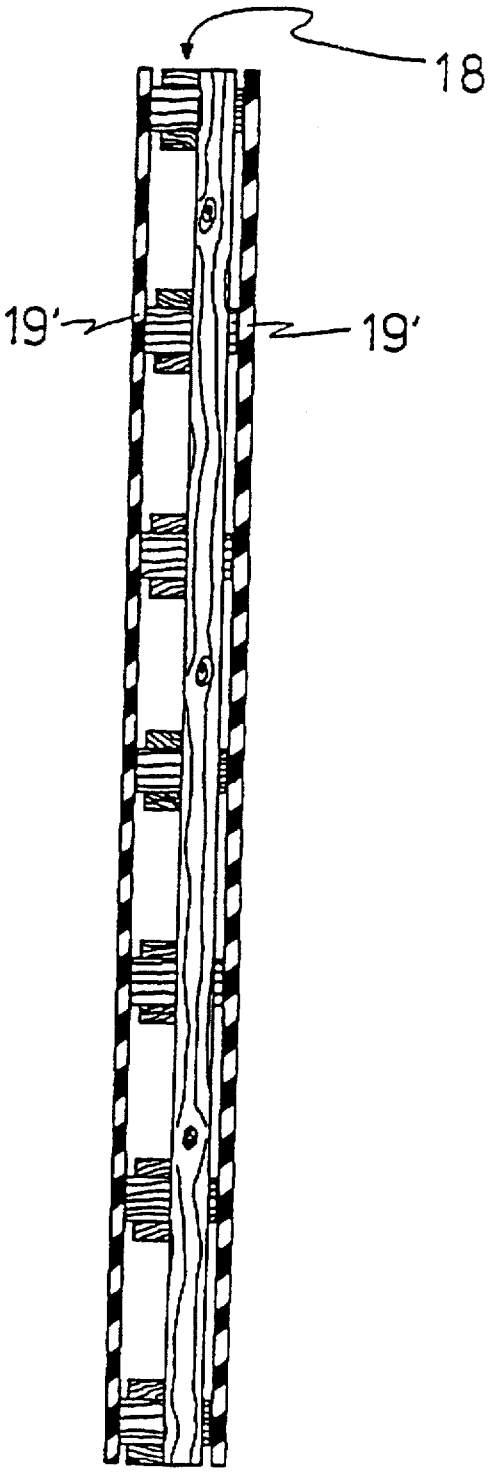
Figure 5:
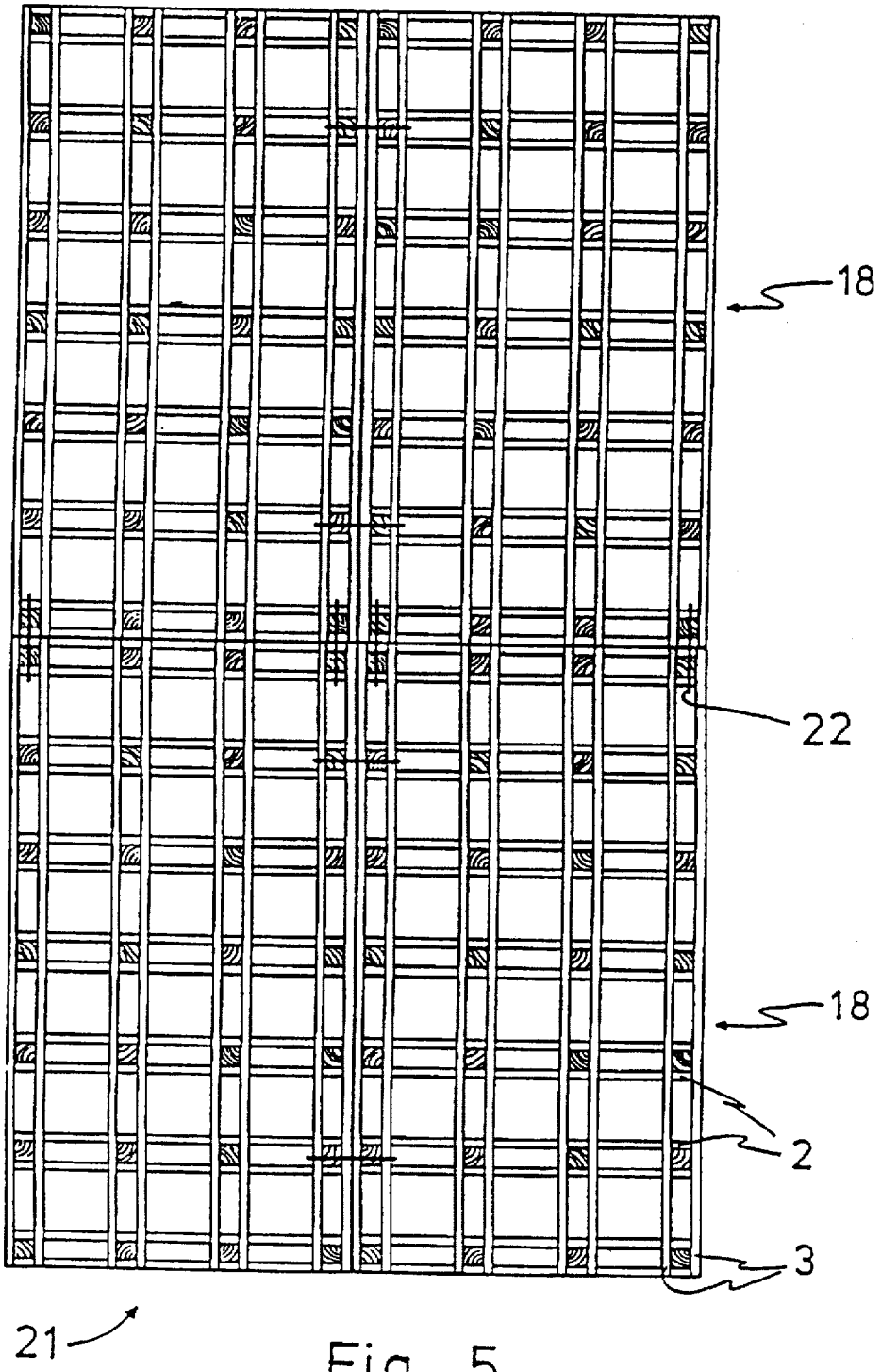

The invention will be more fully explained hereafter with the aid of embodiments showing in FIG. 1, a plan view of a section of a wooden rail structure;

FIG. 2, a perspective illustration of a section of the rail structure relative to FIG. 1;

FIG. 3, a side elevation of a rail structure covered with shuttering panel on one side;

FIG. 4, a side elevation of a rail structure paneled on both sides;

FIG. 5, a plan view of a rail structure composed of several rectangular structural units.

Figure 6:
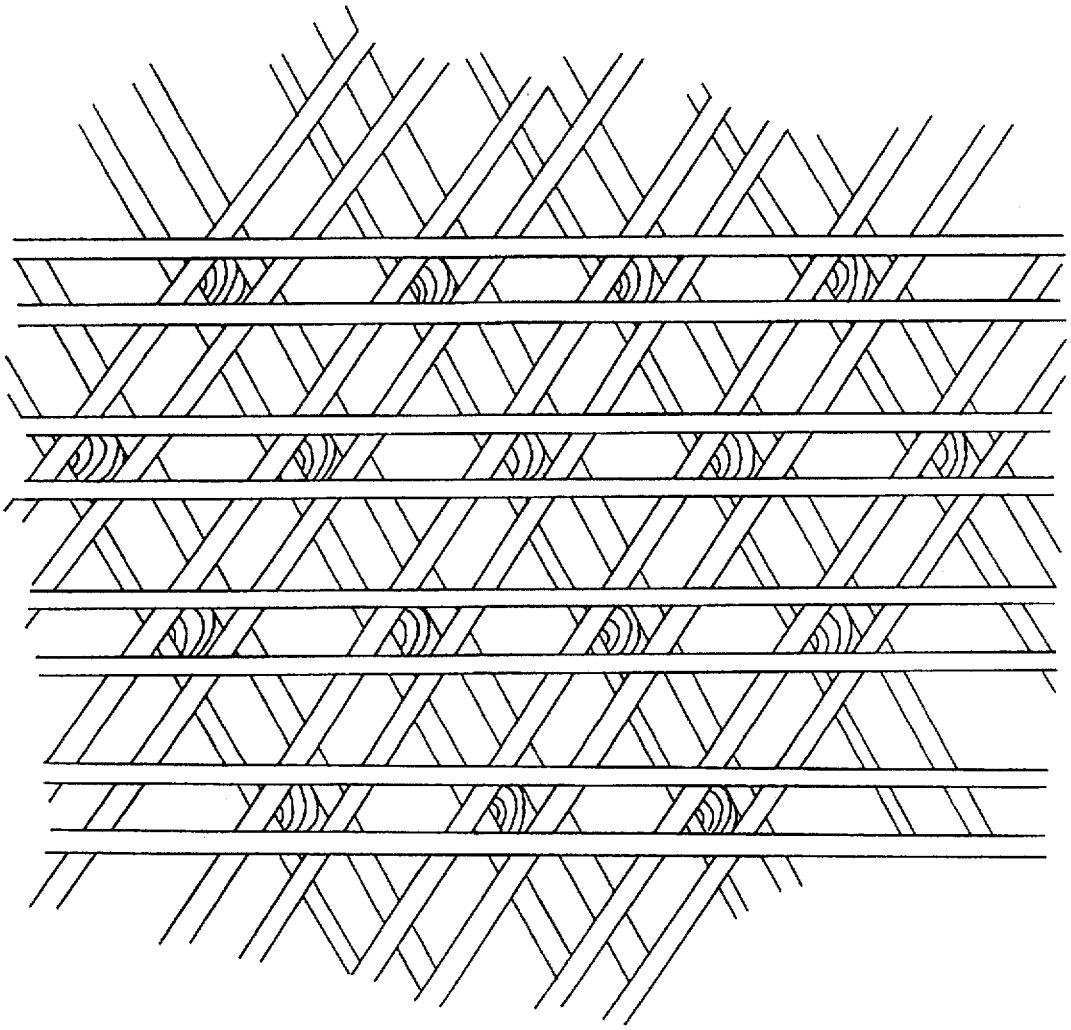

FIG. 6, a plan view of a rail structure composed of a first, second and third plurality of stringer pairs.

FIG. 1 shows a wooden rail structure 1 with essentially parallel slats 2 arranged in a first plane and with essentially parallel slats 3 arranged in a second plane. The slats 2 intersect the slats 3 at right angles. Two each adjacent slats 2 of the first plane form a pair of slats 4, and two each adjacent slats 3 of the second plane form a pair of slats 5. The slats 2 of the slat pair 4 are arranged with a mutual spacing 6 and the slats 3 of the slat pair 5 at a spacing 6'. The slat pairs 4 are arranged at a spacing 7, the slat pairs 5 at a spacing 7'. As illustrated in FIG. 1, the spacings 6, 6' are suitably chosen smaller than the spacings 7, 7'. FIG. 1 shows in both planes same spacings 6, 6' and 7, 7'.

Introduced in the intersection area 8 formed by intersecting of a slat pair 4 with a slat pair 5 is a connecting piece 9 whose side faces are joined nonrotatably to the two slats 2 of the slat pair 4 and the slats 3 of the slat pair 5. The connecting piece 9 fills the intersection area 8 completely, assuring a high shear stability. With low shearing load requirements it is possible as well to provide cross-sectionally different, for instance roundish connecting pieces.

The fiber direction of slats 2, 3 follows their longitudinal expanse, while the fiber direction of the connecting pieces 9 extends essentially at right angles to the fiber direction of the slats 2, 3. This pairwise perpendicular extension of the fiber directions provides thus the option of a firm and durable joint, for example by nailing, between the slats 2, 3 and the side surfaces of the connecting pieces 9.

Double-sided fastening plates (not illustrated) are used for joining the slats 2, 3 to the outside of the connecting pieces 9. The size of the double-sided fastening plates is suitably such that these cover essentially the entire contact area between a slat 2, or a slat 3, and the side surface of a connecting piece 9. The use of double-sided fastening plates allows a swift, exact-fit and stable joining of the slats 2, 3 to the connecting pieces 9. In further embodiments, not illustrated in the drawing, the slats 2, 3 are joined to the connecting pieces 9 by means of other, single-shear or double-shear joint, for instance with staples, nails, screws or bolts.

In a further embodiment not illustrated in the drawing, the spacings 6, 7 of the first plane differ from the spacings 6', 7' of the second plane, forming rectangular intersection areas instead of the quadratic intersecting areas 8 pictured in FIG. 1. It is also possible to choose the spacing 6 and 6' or 7 and 7' identical while making the respectively other spacings different. In a further, not illustrated embodiment, a slat 2, 3 can be coordinated also with two slat pairs 4, 5 in order to obtain thereby an especially high stability in longitudinal or transverse direction.

The area 10 bordered in the upper part of FIG. 1 is illustrated perspectively in FIG. 2. The slats 2 border with a narrow side 11 on a narrow side 12 of the slats 3. The connecting pieces 9 protrude beyond the outward-pointing narrow sides 13, 14 of the slats 2, 3. Any change in form of the wooden slats 2, 3 working transverse to the fiber direction is thus not transmitted to flat structural elements arranged on the end faces 15, 16 of the connecting pieces 9. A protrusion of a few millimeters is sufficient for that purpose. Since the fiber direction of the connecting piece 9 extends perpendicularly to the flat structural element to be arranged on these, a consistent spacing between the flat structural elements is assured in the two-sided paneling of the rail structure.

When it is intended to use slats 2, 3 of a material, such as plastic, which is not subject to form changes, for instance by the effects of weather, the connecting pieces 9 need not extend beyond the narrow sides 13, 14 for reason of form stability.

From FIG. 2 it follows furthermore that the rail structure 1 does not employ any supporting frame to counteract mechanical loads. But it may be desired, for instance for lateral facing of the rail structure 1, to provide a frame. It goes without saying that there is no load-bearing function required then of that frame in support of the rail structure 1.

In another embodiment not illustrated in the drawing either, each slat 2 of the first plane and each slat 3 of the second plane features at its intersecting point 17 with each slat 2, 3 of the other plane a recess. The width of the recess matches the width of the narrow side 11, or 12, of the relevant opposite slat 2, 3 of the other plane. Thus, the slats 2 can be nested with the slats 3 at the intersecting points 17.

Flat structural elements can be arranged on selected end faces 15 and/or 16 of the connecting pieces 9, for instance with the aid of angles. Similarly, a hole (not illustrated) passing through the connecting pieces 9 essentially at right angles to the end faces 15, 16 may be used to insert fasteners in mounting flat structural elements.

In a further embodiment, the slats 2, 3 do not border on each other directly with their narrow sides 11, 12. Providing a certain spacing between slats 2, 3 allows using the rail structure 1, while employing the same slats 2, 3 for a plurality of rail structure thicknesses, without unnecessarily increasing the weight of the rail structure 1 by using heavier slats. It is understood that the connecting pieces 9 need then be made correspondingly longer.

The rail structure 1 is favorably prefabricated in flat, for instance rectangular, structural units 18, a plurality of which is then used to assemble a desired size.

FIG. 3 shows in side elevation a structural unit 18 of the rail structure 1. Provided on the end faces 15 of the connecting pieces 9 is a shuttering panel 19 such as customarily used in concrete formwork. Stylized, the fiber flow in the slats 2, the end faces 20 of the slats 3, and in the connecting pieces 9 can be seen from the drawing.

In addition to its use for supporting shuttering panels, the rail structure 1 may be used with one-sided paneling, for instance as ceiling, roof or wall or as floor.

FIG. 4 shows a structural unit 18 of the rail structure 1 lined on both sides with panels 19'. In such application, the rail structure 1 may be used, e.g., as a wall or partitioning wall or intermediate ceiling. The remaining cavities are then suitably filled with insulation materials in keeping with requirements. When a particular stability of a wall of such make is required, for instance concrete may be poured in the cavities, instead of filling them with insulation material. Walls or ceilings made in this way are usable as prefabricated components into which the concrete is poured only at the construction site. The result is a distinct cost reduction in hauling.

Illustrated in FIG. 5 are four structural units 18 assembled to a rectangular rail structure surface 21 using heavy-duty clamps 22 (illustrated schematically). Such assembly of a plurality of structural units 18 makes it possible to construct larger, collapsible rail structure surfaces 22. When the rail structure 21 needs to follow curving contours or such smaller than an edge length of a structural unit 18, the periphery of the rail structure 21 may be adapted on site to the relevant conditions by simply cutting off sections of the rail structure 21 that are not needed, for instance by sawing, without loss of bending strength, resistance to distortion or shear stability.

The possibility of simple adaptation entails considerable advantages also in stocking, since structural units 18 need be stocked in only few preferred sizes.

When repeated reuse of structural units 18 is intended, as for instance in concrete formwork, an even edge termination such as illustrated in FIG. 3, 4 or 5 is favorably provided, in order to allow quick assembly of a plurality of structural units 18 using customary mounting, locking or alignment systems.

With no even termination provided on a structural unit 18, the slats 2, 3 protrude beyond an intersection area 8 suitably at a length corresponding to the spacing 7, 7'. The narrow sides 11, or 12, of the protruding slats 2, 3 of the first structural unit 18 serve to have fastened on them the narrow sides 11, or 12, of the slats 2, 3 of a second structural unit 18 turned 180 degrees so that, e.g., the sections of the slats 2 of the first structural unit 18 which protrude beyond the connecting pieces 9 border, along said sections, on the narrow sides 11 of the slots 2 of the turned, second structural unit 18. This allows linking a plurality of structural units 18 to form a rail structure, without loss of bending strength, distortion resistance or shear stability, with the end faces 15, 16 of the connecting pieces of all structural units needed being arranged in one plane.

It is quite possible to make the rail structure 1 wholly or also partly of other materials, for instance of plastic, of fibrous plastic or metal, with commercially available shapes and/or hollow shapes being suitably reverted to for the flexible rails 2, 3. The connecting pieces 9 may be made of the same material as the slats 2, 3 or of a different material.

In another embodiment shown in FIG. 6, slats 24 forming slat pairs 25 are provided, in addition to the slats 2 of the first plane and slats 3 of the second plane, also in a third plane in an arrangement corresponding to that of the slats 2 of the first plane, so that the slats 3 of the second plane are arranged between the slats 2 of the first plane and the slats of the third plane. The connecting pieces 9 are dimensioned appropriately longer. Achieved thereby is a greater bending strength of the rail structure 1 in one direction of the rail structure plane, along with an increase in distortion resistance.

A development of this embodiment provides for an intersecting of the slats of the three planes at an angle of 60 degrees, thereby creating hexagonal cross section areas, as shown in FIG. 6. The connecting pieces are hexagonal as well. This rail structure has then an equal load strength in longitudinal and transverse direction.

Provided in another embodiment, in a fourth plane bordering on the third plane, are slats of an arrangement corresponding to that of the slats 3 in the second plane. As opposed to the latter embodiment, a bending strength equal in both directions is thus obtained. As compared to a rail structure with only two planes, the overall load strength is distinctly raised, without necessitating slats with greater bending strength.

I claim:

1. A rail structure for supporting flat structural elements comprising:

a first plurality of parallel stringers forming a plurality of stringer pairs extending in a first plane;

a second plurality of parallel stringers forming a plurality of stringer pairs extending in a second plane, said second plane parallel to said first plane, each said stringer of said first and second plurality of stringer pairs comprising a slat having an essentially rectangular cross-sectional area, said pluralities of stringer pairs disposed adjacently whereby said slats of said adjacent pluralities are in contact, said second plurality of stringer pairs crossing over said first plurality of stringer pairs thereby partially defining a plurality of cross over volumes at each cross over, each said cross over volume having a generally columnar shape and extending in a direction transverse to said first and second parallel planes, said cross over volumes bounded by transverse planes extending in said transverse direction, said transverse planes partially defined by interior facing surfaces of said first and second plurality of stringer pairs at each said cross over; said first plurality of stringer pairs having a first exterior boundary, said second plurality of stringer pairs having a second exterior boundary, said first and second exterior boundaries respectively and partially defined by outer edges of said slats and extending parallel to and respectively defining an outer boundary of said first and second planes, said slats of said first and second pluralities disposed within a generally planar space bounded by said first and second exterior boundaries;

and a plurality of connecting pieces, one said connecting piece disposed in each said cross over volume, each said connecting piece extending in said transverse direction through said first and second exterior boundaries, said connecting pieces each having first and second ends which are respectively disposed in a first and second bearing plane located exterior to and proximate said first and second exterior boundaries whereby said first and second ends are adapted to support said flat structural elements, each said connecting piece having a plurality of sides defining planes generally transverse to said first and second planes, said sides fastened to the interior surfaces of said first and second plurality of stringer pairs at said cross overs.

2. The rail structure according to claim 1 wherein each said connecting piece essentially fills the entire volume of each respective said cross over volume within said space between said first and second exterior boundaries.

3. The rail structure according to claim 1, characterized in that said first plurality of stringer pairs and said second plurality of stringer pairs cross over at essentially right angles, and the spacing between two stringers of each stringer pair of said first plurality of stringer pairs matches the spacing between two stringers of each stringer pair of said second plurality of stringer pairs, and the spacing between two stringer pairs of said first plurality of stringer pairs matches the spacing between two stringer pairs of said second plurality of stringer pairs.

4. The rail structure according to claim 1 wherein the slats of said first and second plurality of stringer pairs have two sets of opposing sides with one of said sets comprising a set of narrow sides and said contact between said first plurality of stringer pairs and said second plurality of stringer pairs occurs between one of the opposing narrow sides of each of said slats of said first plurality of stringer pairs and one of the opposing narrow sides of each of said slats of said second plurality of stringer pairs.

5. The rail structure according to claim 4, wherein said slats further comprise facing recesses at each said cross over, said facing recesses having a width that matches the width of the narrow sides of opposed slats whereby said slats are nestable.

6. The rail structure according to claim 1 wherein said slats and said connecting pieces comprise a wood material having a fiber direction, the fiber direction of each said slat being essentially parallel to the extending direction of said each slat transverse to the first and second parallel planes.

7. The rail structure according to claim 6, characterized in that each said connecting piece is connected with said slats at each respective said cross over by a double-sided fastening plate.

8. The rail structure according to claim 1, further comprising a third plurality of stringer pairs of parallel arrangement provided in a third plane parallel to said first and second planes, each slat of said third plurality of stringer pairs having an essentially rectangular cross sectional area, and said third plurality of stringer pairs aligned to contact one of said first and second plurality of stringer pairs on the narrow side of said slats.

9. The rail structure according to claim 1, further comprising a third plurality of stringer pairs provided in a third plane parallel to said first and second planes, wherein said first and second stringer pairs cross over essentially at an angle of 60 degrees, and said third plurality of stringers cross over said first and second pluralities of stringers at an angle of 60 degrees thereby forming a plurality of hexagonal cross over areas.

10. The rail structure according to claim 1, wherein one of said connecting pieces includes a device for attachment of objects including flat elements.

11. The rail structure according to claim 2 wherein the stringer pairs of the first plurality of stringer pairs and the stringer pairs of the second plurality of stringer pairs cross over at essentially right angles, the spacing between two stringers of a stringer pair of the first plurality of stringer pairs matches the spacing between two stringers of a stringer pair of the second plurality of stringer pairs, and the spacing between two stringer pairs of the first plurality of stringer pairs matches the spacing between two stringer pairs of the second plurality of stringer pairs.

12. The rail structure according to claim 4 wherein said slats and said connecting pieces comprise a wood material having a fiber direction, the fiber direction of each said slat being essentially parallel to the extending direction of said slat and the fiber direction of said connecting pieces extending essentially transverse to the first and second parallel planes.

13. The rail structure according to claim 5 wherein said slats and said connecting pieces comprise a wood material having a fiber direction, the fiber direction of each said slat being essentially parallel to the extending direction of said each slat and the fiber direction of said connecting pieces extending essentially transverse to the first and second parallel planes.

14. The rail structure according to claim 2 further comprising a third plurality of stringer pairs of parallel arrangement provided in a third plane parallel to said first and second planes, each slat of said third plurality of stringer pairs having an essentially rectangular cross sectional area, said third plurality of stringer pairs in contact with one of said first and second plurality of stringer pairs, and each of said pluralities of stringers is arranged in equiangular alignment with said other pluralities of stringer pairs.

15. The rail structure according to claim 3 further comprising a third plurality of stringer pairs of parallel arrangement provided in a third plane parallel to said first and second planes, each slat of said third plurality of stringer pairs having an essentially rectangular cross sectional area, said third plurality of stringer pairs in contact with said second plurality of stringer pairs, and each of said pluralities of stringers is arranged in equiangular alignment with said other pluralities of stringer pairs.

16. The rail structure according to claim 1 further comprising a third plurality of stringer pairs of parallel arrangement provided in a third plane parallel to said first and second planes, each slat of said third plurality of stringer pairs having an essentially rectangular cross sectional area, said third plurality of stringer pairs in contact with one of said other pluralities of stringer pairs, and each of said pluralities of stringers is arranged in equiangular alignment with said other pluralities of stringer pairs.

17. The rail structure according to claim 4 further comprising a third plurality of stringer pairs of parallel arrangement provided in a third plane parallel to said first and second planes, each slat of said third plurality of stringer pairs having an essentially rectangular cross sectional area, said third plurality of stringer pairs in contact with one of said other pluralities of stringer pairs, and each of said pluralities of stringers is arranged in equiangular alignment with said other pluralities of stringer pairs.

* * * * *

UNITED STATES PATENT AND TRADEMARK OFFICE

CERTIFICATE OF CORRECTION

PATENT NO. : 5,722,211

DATED : March 3, 1998

INVENTOR(S) : Rolf Goldschmidt

It is certified that error appears in the above-identified patent and that said Letters Patent is hereby corrected as shown below:

Claim 6, Col. 7, Line 47, before --slat-- delete "each".

Claim 6, Col. 7, Line 47, after "slat" insert -- and the fiber direction of the connecting pieces extending essentially--.

Signed and Sealed this

Twenty-sixth Day of January, 1999

*Attest:*

*Attesting Officer*

*Acting Commissioner of Patents and Trademarks*